United States Patent [19]

Garlinghouse

[11] 4,432,578

[45] Feb. 21, 1984

[54] CLOSED PRESSURE ACTUATED SYSTEM FOR PLACEMENT BUCKET

[76] Inventor: Roland E. Garlinghouse, P.O. Box 109, Heber Springs, Ark. 72543

[21] Appl. No.: 297,130

[22] Filed: Aug. 28, 1981

Related U.S. Application Data

[63] Continuation-in-part of Ser. No. 111,227, Jan. 11, 1980, abandoned.

[51] Int. Cl.[3] ..... B66C 3/16; F15B 15/17

[52] U.S. Cl. ..... 294/69 R; 60/413; 91/417 R; 294/88

[58] Field of Search ..... 294/68, 69 R, 71, 88; 60/403, 404, 413, 560, 563; 91/305, 308, 318, 417 R, 446, 523; 222/503, 504; 414/626

[56] References Cited

U.S. PATENT DOCUMENTS

| | | | |
|---|---|---|---|
| 2,217,283 | 10/1940 | Lorrin | 294/69 R |
| 2,812,970 | 11/1957 | Martinson | 294/71 |
| 2,856,222 | 10/1958 | Gossett et al. | 294/71 |
| 3,104,125 | 9/1963 | Garlinghouse | 294/69 R |
| 3,791,690 | 2/1974 | Garlinghouse | 294/71 |
| 4,161,135 | 7/1979 | Garlinghouse | 91/417 R |

FOREIGN PATENT DOCUMENTS

| | | | |
|---|---|---|---|
| 993960 | 11/1951 | France | 294/68 |
| 565211 | 7/1957 | Italy | 294/71 |

*Primary Examiner*—Johnny D. Cherry

*Attorney, Agent, or Firm*—Beehler, Pavitt, Siegemund, Jagger & Martella

[57] ABSTRACT

A placement bucket for placing material such as concrete in forms by manipulation of clam shell gates in response to action of a power cylinder makes use of a hydraulic fluid system which prevents opening the gates of a full or partially full bucket of material unless there is a sufficient reserve of pressure and fluid volume to make certain of closing the gates at any time. The system is provided with a precharged fluid supply under pressure into which additional fluid is diverted when generated in a master cylinder by lifting a piston against the weight of the bucket and its contents. A sequence valve prevents flow of fluid to the power cylinder until an optimum amount of fluid pressure and volume is reached. An auxiliary direction valve in a fluid return line can be manipulated to temporarily block return flow of fluid from the exhaust side of the power cylinder to a reservoir, in that way to temporarily fix the partially or full open position of the gates.

12 Claims, 4 Drawing Figures

CLOSED PRESSURE ACTUATED SYSTEM FOR PLACEMENT BUCKET

This is a continuation-in-part of Application Ser. No. 111,227, filed Jan. 11, 1980, now abandoned.

In placing of wet concrete in forms, and especially for heavy construction work, a common expedient has been to make use of a bucket which can be loaded with concrete at a convenient source, then lifted, and moved to a position above the unfilled form where the concrete is released by manipulation of a gate at the bottom of the bucket. Because gates are often large, as is necessary when buckets contain many cubic yards of semi-fluid concrete, it has been found advantageous, and virtually necessary, to use a power actuated gate. Both liquid power and gas power systems have been made use of. Customarily gas or liquid pressure from an outside source is fed to the bucket, thereby to provide the power for operation.

A problem which has been encountered is one where, after the gate has been opened, at a location remote from the source of power, insufficient power remains to completely close the gate. When this occurs before the bucket is completely emptied, wet concrete then gets spilled at locations where it is very undesirable.

Some expedients have heretofore been devised for making certain of there being ample reserve power to close the gate at any time. Reference is made to U.S. Pat. Nos. 4,161,135 and 3,104,125.

More recently systems have been devised which dispense with the need for supplying gas or liquid power from an external source. Such systems make use of one or more master cylinder assemblies, the cylinder being mounted on the bucket and a piston being attached to the lifting cable so that the weight of the bucket and its contents acting against the piston during the lifting cycle generates adequate power and volume for the operating fluid, be it gas or liquid, which is subsequently used as the power for opening and closing the bucket gates.

Since, in a system of the kind last mentioned, there is a finite limit to the amount of power which can be generated and the volume of fluid which can be made available for each placement cycle, many of such systems frequently run out of power and also run out of fluid in sufficient quantity to be certain of closing the gates should some wet concrete remain in the bucket. Expedients for holding power in reserve, under circumstances where the power is supplied from an outside source, have not been readily adaptable to buckets where the power is generated by lifting the bucket and its contents.

As a make-shift assurance of having adequate power, one practice has been to add weight to the bucket over and above the weight of the bucket and its contents so that adequate weight will remain in the system even after the bucket is empty. An important drawback to such an expedient is that under such circumstances the bucket is always overweight, requiring more power to be moved about, a more rugged construction for the lifting and transportation expedients, such as cranes and trolley, and undue wear due to the excess weight. In actual practice, because of the size of equipment of this kind, scrap iron in the form of railroad car wheels, rails, and the like, have been strapped to buckets, in that way to add to the weight.

It is therefore among the objects of the invention to provide a new and improved pressure activated system for a material handling device which, by employment of precharged accumulators, makes certain that there is an abundance of residual operating potential to deactivate the system after it has been activated.

Another object of the invention is to provide a new and improved pressure activated system for a material placement bucket which is safety oriented in that after the system has been activated, should there be any discontinuance in attention, the system will be automatically deactivated.

Still another object of the invention is to provide a new and improved pressure activated system for a material placement bucket wherein when the bucket has been opened to a desired degree, the open position can be temporarily frozen for as long as desired, after which the system can be unfrozen and the gate either opened wider, if such be the need, or immediately closed.

Still another object of the invention is to provide a new and improved pressure activated system for a material placement bucket which is capable of monitoring the internal pressure and volume to a degree such that the gate cannot be opened unless there is sufficient pressure and volume available after the opening, to close it again whether or not the contents have been completely dispensed.

Still further among the objects of the invention is to provide a new and improved pressure activated system for a material placement bucket wherein pressure is generated by lifting against the weight of the bucket and contents and which, by making use of accumulators, provides higher gate opening and closing pressures, together with an increase in quantity of operating fluid, thereby to make it unnecessary to add weight in order to assure a complete closing cycle for every opening cycle.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

Figure 2:
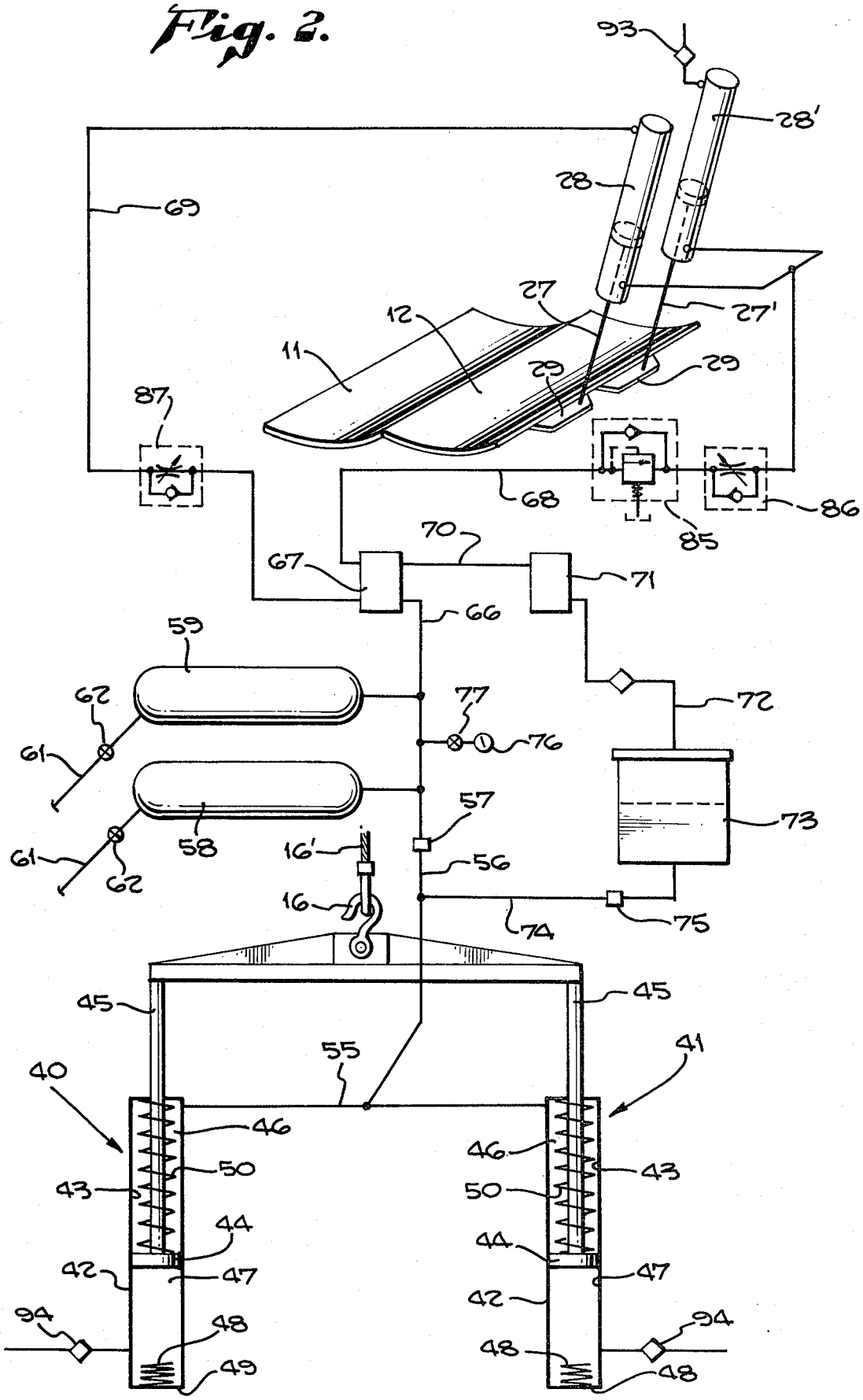
FIG. 2 is a schematic exploded view of interrelated mechanical and hydraulic components.

In an embodiment of the invention chosen for the purpose of illustration there is shown a bottom opening concrete placement bucket indicated generally by the reference character 10 provided with a pair of clam shell gates 11 and 12, a frame 13 enabling it to be rested on a supporting surface 14, and a sling 15 provided with a lifting hook 16 for attachment of an appropriate cable 16' (FIG. 2).

The bucket features a hopper 17 with side walls 18 sloping progressively inwardly toward a chute 19 at the bottom, the lower end of which has an opening 20 closed by the clam shell gates 11 and 12.

The gates 11 and 12 are of substantially conventional construction, provided with respective wings 21 and 22.

Figure 1:
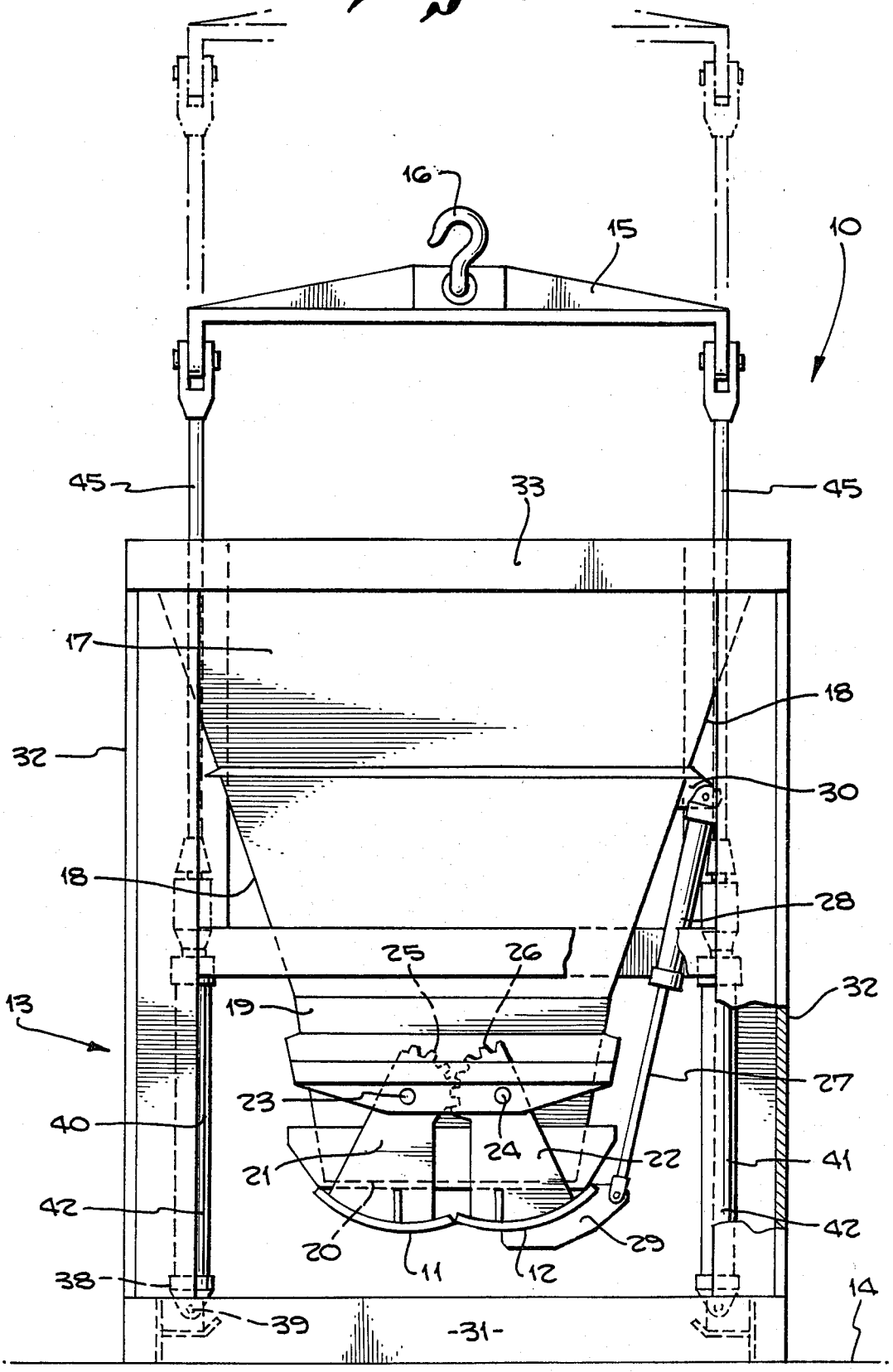
FIG. 1 is a side elevational view of a typical large volume placement bucket featuring hydraulic actuated clam shell gates.

The wings are pivoted about individual pivot axes 23 and 24, intermeshing gear teeth 25 and 26 being made use of so that when the gate 12 is moved either toward open position or closed position, the gate 11 will move a corresponding amount in the opposite direction. Fluid operating cylinders 28, 28', one of which is shown in FIG. 1, provide power and movement for respective piston rods 27, 27' which in turn are pivotally attached to a bracket 29 of the gate 12. A bracket 30 provides for a pivotal attachment of the upper ends of the operating cylinders 28, 28'.

A base ring 31, which is adapted to rest on the supporting surface 14, provides a support for columns 32, an upper ring 33 being attached to upper ends of the columns, where the hopper 17 is attached.

Of special significance are the master cylinders 40 and 41. For the cylinder 40 there is a cylindrical jacket 42, at the lower end of which is a cap 38 having a pivot pin 39 attaching the cylindrical jacket to the base ring 31.

Within the cylindrical jacket 42, as better shown in FIG. 2, is a chamber 43 accommodating a piston head 44 partitioning the chamber into an upper section 46 and a lower section 47. A piston rod 45 interconnects the piston head 44 with the sling 15. The master cylinder 41 is equipped in the same fashion as has been described for the master cylinder 40.

Although the sling 15 and its lifting hook 16 have for a primary function lifting the bucket 10 and transporting it from a loading position to a dump or concrete placement position, the sling has a second important function. When the bucket is at rest on a supporting surface 14, the piston head 44 bottoms against a cushion 48 at a lower end 49 of the cylinder jacket 42. Although the weight of the sling, piston rods 45 and piston heads 44 may be depended upon to move the piston heads to the lower ends 49, springs 50 may additionally be provided. Since the chamber 43 of the cylinder jacket 42 in each case is part of the liquid hydraulic fluid operating system, when the piston heads are in their lowermost position, the upper sections 46 will be at maximum capacity for the fluid, whatever it may be. Thereafter, when the sling 15 is lifted, as by means of the lifting hook 16, the piston heads will be first pulled upwardly within the respective chambers 43, thereby to generate liquid pressure in the upper sections 46 until the liquid pressure is at a point comparable to the weight of the bucket and contents, whereafter continued upward lift of the lifting hook 16 will lift the bucket off the supporting surface so that it can be transported to a desired location.

Figure 3:
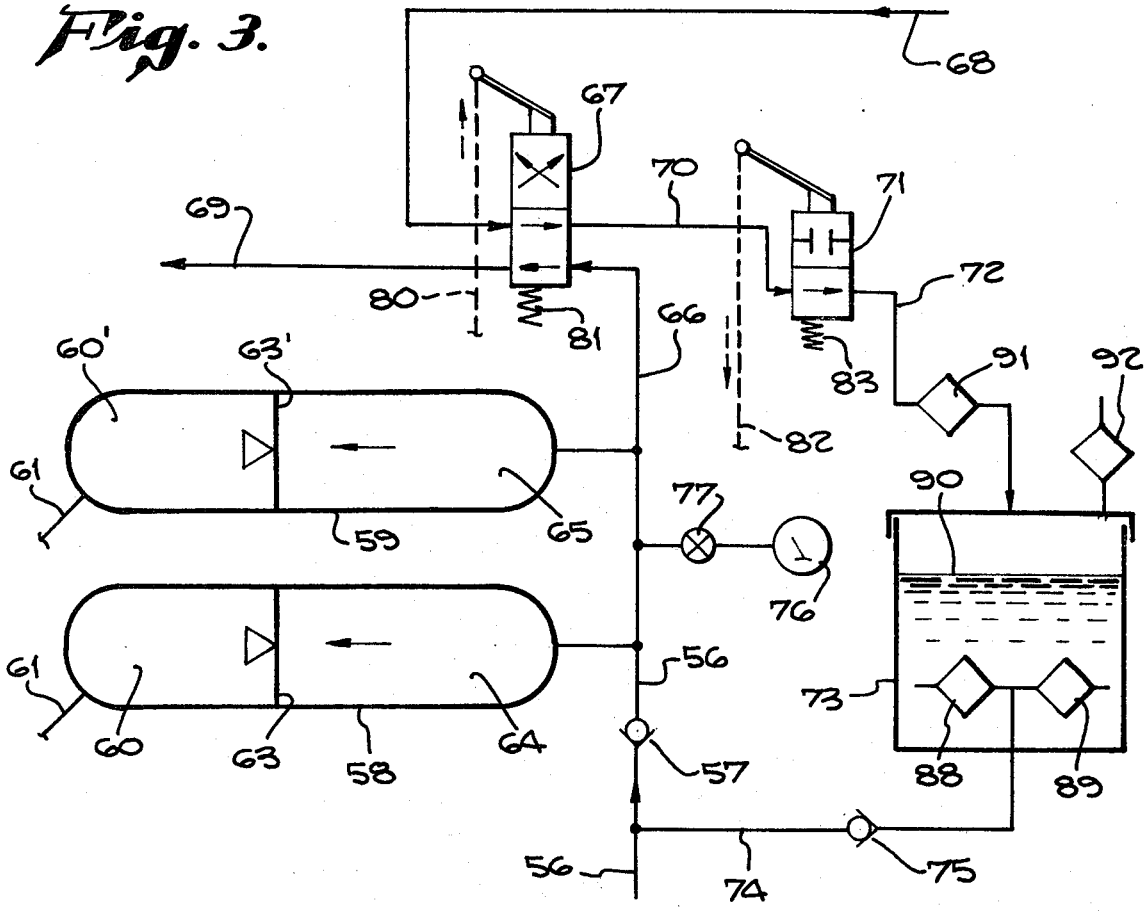
FIG. 3 is a partial schematic view of the hydraulic circuit in gate closing attitude.
Figure 4:
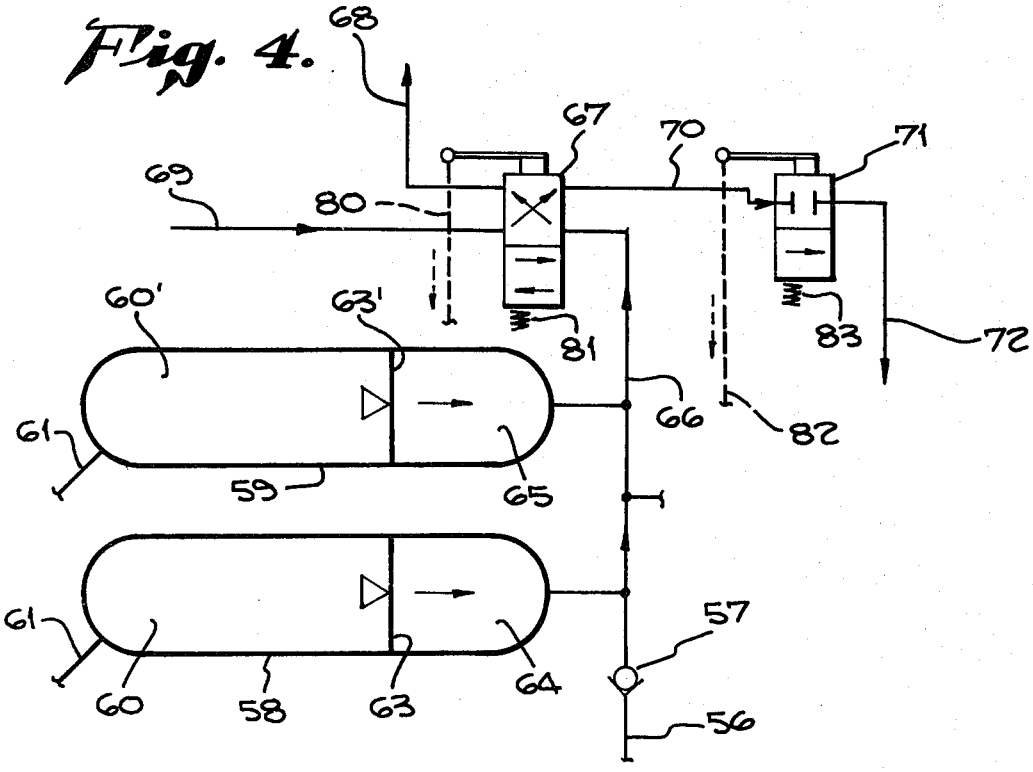
FIG. 4 is a view similar to FIG. 3 but in gate open attitude.

The fluid system, preferably hydraulic in the chosen form of the invention, which is supplied by the liquid under pressure generated in the cylindrical jackets, supplies the hydraulic system, as shown in FIGS. 2, 3 and 4, for opening and closing the clam shell gates 11 and 12. Once the system has been charged with an adequate amount of liquid hydraulic fluid, there need be no further outside supply of fluid nor source of pressure for operation of the gates.

In the hydraulic fluid system, as depicted in FIGS. 2, 3 and 4, a liquid line 55 intercommunicating with the upper sections 46 of the respective master cylinders 40 and 41 is in communication with a fluid line 56 through an upwardly open check valve 57 with respective accumulators 58 and 59. For added effectiveness, the accumulators 58, 59 may have the left-hand chambers 60, 60' precharged with a compressible fluid to a specific pressure supplied through lines 61 through appropriate shut-off valves 62. In the accumulator 58 a movable diaphragm 63 separates the left-hand chamber 60 from a right-hand chamber 64, which receives the liquid hydraulic fluid. A similar diaphragm 63' for the accumulator 59 provides for a right-hand chamber 65. It is of interest that the liquid in these right-hand chambers 64 and 65 is always under some pressure and that such pressure is available to both opening and closing sides of the operating cylinders 28, 28'. By reason of the presence of an initial quantity of the liquid hydraulic fluid in the right-hand chambers 64 and 65, where it serves to augment the quantity and pressure of liquid hydraulic fluid in the master cylinders 40 and 41, there will always be a quantity of the liquid hydraulic fluid substantially in excess of that needed to activate the operating cylinders 28, 28' for each initial actuation of the operating cylinders.

By reason of the distribution of the liquid hydraulic fluid just made reference to, the master cylinders 40 and 41 need not be limited to a capacity no less than the capacity of the operating cylinders. In this arrangement the accumulators are therefor always in constant communication with and a functional part of the system. They are accordingly not safety features to be cut into the system and called upon only in the event of an emergency.

A fluid line 66, supplied by both of the accumulators 58 and 59, communicates with a primary direction control valve 67. From the primary direction control valve 67, one fluid traverse line 68 is in communication with the opening side of respective operating cylinders 28 and 28'. A second fluid traverse line 69 communicates between the primary direction control valve 67 and the closing side of the operating cylinder 28.

A return line 70 from the primary direction control valve 67, in which is located a secondary direction control valve 71, communicates through a return line 72 with a reservoir 73. From the reservoir 73 a re-supply line 74, in which is a check valve 75, interconnects with the fluid line 56 previously made reference to.

For a more detailed understanding of the operation of the hydraulic fluid system of this embodiment of the invention, reference is made to FIGS. 3 and 4 where, particularly in FIG. 3, the direction control valves 67 and 71 are shown in their normal positions. Normal position for the primary direction control valve is closing position for the operating cylinder 28. As shown in FIG. 3, the primary direction control valve 67 is open between the fluid line 66 and the fluid traverse line 69, and also open between the fluid traverse line 68 and the return line 70. The secondary direction control valve 71 is also open to provide communication between the return line 70 and the return line 72 and thence to the reservoir 73.

In operation let it be assumed that the handles of the directional control valves 67 and 71 are in the normal, upper positions shown in FIG. 3, the bucket resting on the supporting surface 14 at a loading station. In this attitude, the accumulators 58 and 59 are precharged to a desired pressure, as determined by a gage 76 when a valve 77 is open.

At this stage of operation the piston heads 44 will bottom in the master cylinders 40 and 41, as exemplified by the cylindrical jackets 42 in FIG. 2. As the piston heads move downwardly, hydraulic fluid flows from the reservoir 73 through the check valve 75 and re-supply line 74 to the fluid lines 56 and 55, thence into the upper sections 46 of the respective master cylinders. Fluid pressure in the fluid line 66, which is accounted for by the precharge in the accumulators 58 and 59, not being able to pass the check valve 57, is available through the fluid traverse line 69 to supply the closing side of the operating cylinder 28. In this attitude the gates 11 and 12 are forced to closed position.

With the bucket 10 now being filled with its load of wet concrete, the sling 15 is lifted by application of the cable 16' to the lifting hook, and the piston heads 44 are pulled upwardly against the volume of hydraulic fluid in the upper sections 46, the upward motion being resisted by the weight of the bucket and its contents. As a consequence, pressure is generated in the hydraulic fluid in the upper sections 46, and the hydraulic fluid flows through the fluid lines 55 and 56. Not being able to pass the check valve 75, but being able to pass the check valve 57, the fluid charges the right-hand chambers 64 and 65 of the respective accumulators 58 and 59, shifting the diaphragm 63, 63' against the supercharge of the compressible fluid in the left-hand chambers 60 and 60'. This condition prevails as long as lifting pressure is applied to the sling 15 as it is moved from a loading station to a discharge station over forms which are to be filled.

Upon reaching the discharge station over the form, the gates are designed to be opened to the extent desired by the operator. To open the gates, the operator pulls downwardly upon a chain 80 of the primary directional control valve 67. This moves the valve handle down against pressure of the return spring 81 until the valve handle is in lowermost position. With the valve handle in its lowermost position, fluid under pressure from the fluid line 66 is diverted to the fluid traverse line 68 which supplies the opening side of both of the operating cylinders 28, 28'. At the same time, the fluid traverse line 69 in communication with the closing side of the operating cylinder 28 is diverted to the return line 70.

With the handle of the secondary directional control valve 71 remaining in its normal upper position, the fluid from the operating cylinder 28 continues in its path through the return line 72 to the reservoir 73. Should the operator wish to close the gates at any time, it is necessary only to release the chain 80, whereupon by action of the return spring 81 the primary directional control valve handle will be moved upwardly to the upper position, cutting off flow to the opening ends of the operating cylinders and directing flow to the closing end of the operating cylinder 28.

Should the operator, for example, wish to freeze the gates at some selected partially open position, the chain 80 is first pulled downwardly so as to shift the handle of primary directional control valve 67 to its lower position, as previously described, until the clam shell gates are open to the extent desired, at which point the operator pulls downwardly upon a chain 82 of the secondary directional control valve 71. Both directional control valves will then be in the positions shown in FIG. 4. The effect of this is that when the handle of the secondary directional control valve 71 is moved to its lower position as shown, flow through the return line 70 to the return line 72 is blocked. Since no more hydraulic fluid can flow out of the closing end of the operating cylinder 28, hydraulic fluid trapped therein prevents movement of the operating cylinders 28, 28' any further toward opening position, and the open position previously achieved remains frozen or fixed.

With the operator continuing to pull downwardly on the chain 80 holding the handle of the primary directional control valve in its lower position, if the chain 82 of the secondary directional control valve 71 is released, flow will be resumed through the return lines 70 and 72 from the closing side of the operating cylinder 28 and the operating cylinders will then continue to move in an opening direction, supplied with fluid under pressure from the accumulators and the fluid line 66.

In the alternative, and assuming both directional control valves in the positions of FIG. 4, if the operator should release pull on the chain 80, the handle of the primary directional control valve 67 will then be moved upwardly to its normal position by action of the return spring 81. While the handle of the secondary directional control valve 71 remains in its lower position because of tension on the chain 82, no closing of the gates will take place because hydraulic fluid is trapped in the opposite or closing ends of the operating cylinders 28, 28' because flow in the return lines 70, 72 to the reservoir is blocked. Under this circumstance, however, when tension is released on the chain 82 permitting the return spring 83 to move the handle of the secondary directional control valve 71 to its upper position, the unblocked position is relieved, fluid can then flow from the lower ends of the operating cylinders 28, 28', and closing will commence by action of the operating cylinder 28, supplied as it is with fluid under pressure on the closing side.

Of special significance is the presence of a pressure actuated sequence valve 85 located in traverse line 68, as shown in FIG. 2. The sequence valve 85 is one of the conventional construction designed to remain closed until a selected pressure has been reached in the traverse line 68. This action prevents flow through the traverse line 68 to the opening sides of the operating cylinders 28, 28' until there has been a buildup of pressure in the accumulators 58 and 59, together with appropriate volume, in excess of that needed to ultimately close the clam shell gates 11 and 12 once they have been opened.

Further still, in the course of operation, should the sequence valve 85 at any time sense when the pressure has fallen to a predetermined level, it will block any further flow to the opening side of the operating cylinders and, as a consequence, there will remain sufficient pressure and volume to close the clam shell gates from whatever position they may have been opened to.

As a further assurance against malfunction, there may be provided in the fluid traverse line 68 a flow control valve 86. A suitable adjustment of the flow control valve 86 may be made to determine the speed of closing for the clam shell gates or other special condition which may exist. A similar type of flow control valve 87 may be provided in the fluid traverse line 69, limiting the flow of hydraulic fluid from the closing side of the operating cylinder 28, to adjust the opening speed in order to suit prevailing job conditions.

Cushions 48 have been identified as providing a cushioning effect when the piston heads 44 bottom in the cylindrical jackets 42. Presence of the accumulators 58, 59 supercharged initially provide a cushioning effect when the bucket is initially hoisted, thereby reducing hydraulic shock in the system and also when the piston heads bottom at the upper ends of the same cylindrical jackets. Additional cushions at the upper ends (not shown) may be provided as needed.

To add further to the dependability of the system as a hydraulically operated system, suction strainers 88 and 89 may be located below the liquid level 90 in the reservoir 73 to maintain a clear flow through the re-supply line 74. A return line filter 91 is supplied for the return line 72. A breather filler unit 92 may further be provided for the reservoir 73, a comparable breather 93 being supplied at the exhaust end of the operating cylinder 28'. Breathers 94 may also be provided for lower ends 47 of the master cylinders 40 and 41.

After the dumping or placement cycle for concrete from the bucket has been completed, the bucket is returned to the loading station and again permitted to rest upon the supporting surface 14. As tension is released on the lifting hook 16, the piston heads 44 again move to their lowermost positions in the cylindrical jackets of the master cylinders 40, 41. Fluid flows from the reservoir 73 into the upper sections 46. Accordingly, once the bucket has been refilled with concrete the system is immediately ready for another placement cycle of operation.

It should be noted that for a particular bucket design or type of concrete being handled both the volume and the pressure generated by the master cylinders is varied by selecting cylinders of different bores and strokes. The volume displaced by the master cylinders must be appropriate to yield the desired number of gate cycles. Likewise, the bore of the master cylinders must be appropriate to yield the desired pressure to open and close the gate under the various loading conditions assumed by the bucket under actual field circumstances.

While a particular embodiment of the present invention has been shown and described, it will be obvious to those skilled in the art that changes and modifications may be made without departing from the invention in its broader aspects, and therefore, the aims of its appended claims is to cover all changes and modifications as fall within the true spirit and scope of the invention.

Having described the invention, what is claimed as new in support of Letters Patent is as follows:

1. A closed fluid pressure actuated system for a material placement bucket equipped with a dispensing gate, operating cylinder means for said gate having opening and closing sides, and piston means in said cylinder means in operating engagement with said gate having full opening and closing strokes, said system comprising a charge of non-compressible hydraulic fluid normally under pressure, lifting means for the bucket, a pressure generating master cylinder assembly having one complementary part attached to the bucket and another complementary part attached to the lifting means and adapted to generate additional fluid pressure, a plurality of traverse lines between said operating cylinder means and said master cylinder assembly, fluid accumulator means in communication with said traverse lines for accumulation of a quantity of fluid under pressure generated by the lifting of said bucket and storage of said fluid, said accumulator means comprising a closed chamber, a first portion of said closed chamber containing compressible fluid under pressure, a second portion of said closed chamber containing a quantity of said non-compressible fluid and diaphragm means comprising a separator between said compressible fluid and said non-compressible fluid, one of said traverse lines being in communication with the opening side of said operating cylinder means and another of said traverse lines being in communication with the closing side of the operating cylinder means, and a primary directional control valve in communication with said traverse lines, said primary directional control valve having a normal position interconnecting said master cylinder assembly and said accumulator means with the closing side of said operating cylinder means and having an actuating position interconnecting said master cylinder assembly and said accumulator means with the opening side of the operating cylinder means.

2. A fluid pressure actuated system as in claim 1 wherein said accumulator means has a precharged pressure in an amount of substantially one-third of the maximum pressure generated by the master cylinder assembly.

3. A fluid pressure actuated system as in claim 2 wherein the precharged pressure of the accumulator means is the pressure of a compressible fluid in a separate sealed expandable chamber in said accumulator means.

4. A fluid pressure actuated system as in claim 1 wherein the pressure generated in said master cylinder assembly is in excess of optimum operating pressure for said operating cylinder means and there is a pressure actuated sequence valve in a selected one of said traverse lines for the opening of the sequence valve and initiation of an opening cycle for the operating cylinder means until the volume and pressure of fluid in the accumulator means is at least equal to that required for a complete closing cycle.

5. A fluid pressure actuated system as in claim 1 wherein there is a flow control valve in the traverse line for the opening side of the operating cylinder means whereby to control the speed of opening of the gate.

6. A fluid pressure actuated system as in claim 1 wherein there is a flow control valve in the traverse line for the closing side of the operating cylinder means whereby to control the speed of closing of the gate.

7. A fluid pressure actuated system as in claim 1 wherein there is a flow control valve in the traverse line for the opening side of the operating cylinder means whereby to control the speed of closing of the gate.

8. A fluid pressure actuated system as in claim 1 wherein there is a flow control valve in selected ones of said traverse lines for the operating cylinder means whereby to control the speed of gate movement for both the opening and closing cycles.

9. A fluid pressure actuated system as in claim 1 wherein there is a second directional control valve in another selected one of said traverse lines downstream from the primary directional control valve, the second directional control valve having a normal position passing fluid from the primary directional control valve toward the master cylinder assembly and a second position blocking passage of fluid from said primary directional control valve.

10. A fluid pressure actuated system as in claim 9 wherein there is a fluid reservoir between said second direction control valve and said master cylinder assembly.

11. A fluid pressure actuated system as in claim 9 wherein there is automatic means in operative relationship with the second directional control valve acting in a direction to move said second directional control valve to said normal position.

12. A fluid pressure actuated system as in claim 1 wherein the quantity of hydraulic fluid accumulated by said accumulator means is not less than the quantity of hydraulic fluid needed for said full strokes of the piston means.

* * * * *